US005569971A

United States Patent [19]

Clifford et al.

[11] Patent Number: 5,569,971

[45] Date of Patent: Oct. 29, 1996

[54] READILY ASSEMBLED SPARK ELECTRODE

[76] Inventors: Gerald R. Clifford, 15 Strawberry Ln., Rolling Hills Estates, Calif. 90274; James Wang, 5762 Bellfield La., Huntington Beach, Calif. 92648

[21] Appl. No.: 221,840

[22] Filed: Mar. 31, 1994

[51] Int. Cl.[6] ..... H01T 13/56

[52] U.S. Cl. ..... 313/141; 313/136; 313/144

[58] Field of Search ..... 313/141, 144, 313/136, 145; 445/3

[56] References Cited

U.S. PATENT DOCUMENTS

| | | | |
|---|---|---|---|
| 1,066,979 | 7/1913 | Bacon | 313/145 |
| 1,922,175 | 8/1933 | Rohde | 313/145 |
| 1,953,229 | 4/1934 | Heron | 313/141 |
| 1,995,483 | 3/1935 | Rabezzama | 313/145 |
| 2,267,571 | 12/1941 | McDougal | 313/145 |
| 2,330,807 | 10/1943 | Berstler | 313/145 |
| 2,350,396 | 6/1944 | Gretzinger et al. | 313/145 |
| 2,399,299 | 4/1946 | Soliveras, Jr. | 313/145 |
| 2,835,726 | 5/1958 | Beesch | 313/145 |
| 2,864,884 | 12/1958 | Counts et al. | 313/145 |
| 3,134,230 | 5/1964 | Lynch | 313/145 |
| 3,229,032 | 5/1960 | Willis | 373/144 |
| 3,229,144 | 1/1966 | Poland | 313/145 |
| 3,295,005 | 12/1966 | Poellet et al. | 313/145 |
| 3,346,760 | 10/1967 | Jalbing et al. | 313/145 |
| 3,753,795 | 8/1973 | Weber | 148/428 |
| 4,081,710 | 3/1978 | Heywood et al. | 313/141 |
| 4,314,392 | 2/1982 | Waite | 313/141 |
| 4,400,643 | 8/1983 | Nishio et al. | 313/141 |
| 4,853,582 | 4/1988 | Sato et al. | 313/141 |

*Primary Examiner*—Donald J. Yusko
*Assistant Examiner*—Michael Day
*Attorney, Agent, or Firm*—Patent Law & Venture Group; Gene Scott

[57] ABSTRACT

A spark electrode assembly and method of assembling same is disclosed. A ceramic housing having a cylindrical passage provides clearance for a conductive metal electrode of rod construction. The electrode has a body portion having a relatively large diameter, an emitter portion of relatively smaller diameter extending concentrically from one side of the body portion, and an umbrella-shaped portion extending concentrically from the other side of the body portion. During assembly, the electrode is inserted into the passage of the ceramic housing until the umbrella portion of the electrode makes contact with an annular side wall of the passage. An impact force on the electrode forces the umbrella portion to expand radially outwardly, thereby engaging an annular groove portion of the ceramic housing for holding the electrode in the housing. Further, the one end of the electrode body is simultaneously deformed by the impact force radially outwardly until it firmly engages the inner wall of the passage of the housing, thereby preventing the electrode from moving within the housing. That part of the electrode body that is not in contact with the housing still has ample room to expand within the housing.

4 Claims, 2 Drawing Sheets

READILY ASSEMBLED SPARK ELECTRODE

FIELD OF THE INVENTION

This invention relates generally to spark electrodes and, more specifically, is directed towards a spark electrode construction that allows for simplified assembly thereof.

BACKGROUND OF THE INVENTION

Almost all spark electrodes, from those used in combustion engine spark plugs to gas heater ignitors, have a central metallic conductor housed in a ceramic or glass insulator. A fundamental difficulty with such electrodes has been that the thermal expansion rate of the interior electrode is greater than that of the surrounding ceramic insulator. As such, as the electrode becomes hotter during use and expands, it applies pressure to the inside wall of the insulator. Such ceramic and glass insulators are by their nature extremely brittle, and thus are prone to cracking under thermal expansion pressure from the electrode. A further problem with such prior art devices is that the electrode must be firmly mounted within the housing in such a way that it will not become loose over time. The methods heretofore used for assembling the electrode to the housing are at once expensive and often require more components than just the electrode and ceramic housing.

Several prior art devices are available that reduce the chance of such structural failure and provide unique methods for holding the electrode in place within the ceramic housing. For example, such devices are taught in U.S. Pat. No. 2,267,571 to McDougal on Dec. 23, 1941; U.S. Pat. No. 3,346,760 to Jalbing et al. on Oct. 10, 1967; U.S. Pat. No. 3,229,144 to Poland on Jan. 11, 1966; U.S. Pat. No. 3,134,230 to Lynch on May 26, 1964; and U.S. Pat. No. 3,295,005 to Poellet et al. on Dec. 27, 1966. Such devices typically teach that the electrode is to be fixed to the ceramic housing by braising processes, or by melting the ceramic or glass housing around the electrode and letting the molten glass set the electrode into place. Other prior art devices teach a spark electrode assembly having multiple parts that cooperate to hold the electrode in place. All of these prior art solutions are relatively expensive, and many require more than two parts. As such, the prior art devices tend to be relatively complex, and thus more prone to failure.

Clearly, then, there is a need for a spark electrode device that can be readily assembled and that comprises only the two basic parts of the electrode and the insulating, ceramic housing. Such a needed device would accommodate the thermal expansion of the electrode. Such a needed device would further allow for the thermal contraction of the electrode while still firmly holding the electrode in place within the housing. The present invention fulfills these needs and provides further related advantages.

SUMMARY OF THE INVENTION

The present invention is a spark electrode assembly and method of assembling same. A ceramic housing having a cylindrical passage provides clearance for a conductive metal electrode of rod construction. The electrode has a body portion having a relatively large diameter, an emitter portion of relatively smaller diameter extending concentrically from one side of the body portion, and an umbrella-shaped portion extending concentrically from the other side of the body portion. During assembly of the device, the electrode is inserted into the passage of the ceramic housing until the umbrella portion of the electrode makes contact with an annular side wall of the passage. An impact force on the electrode forces the umbrella portion to expand radially outwardly, thereby engaging an annular groove portion of the ceramic housing for holding the electrode in the housing. Further, the one end of the electrode body is simultaneously deformed by the impact force radially outwardly until it firmly engages the inner wall of the passage of the housing, thereby preventing the electrode from moving within the housing. That part of the electrode body that is not in contact with the housing still has ample room to expand within the housing.

The present invention is a spark electrode device that can be readily assembled without requiring heating, braising, or adhesive application processes. The device of the present invention comprises only the two basic parts of the electrode and the insulating, ceramic housing, making the device relatively inexpensive to manufacture and assemble. The present device allows for the thermal expansion of the electrode without applying significant expansion pressure on the ceramic housing. The present device further allows for the thermal contraction of the electrode without the electrode becoming loose within the housing. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 2:
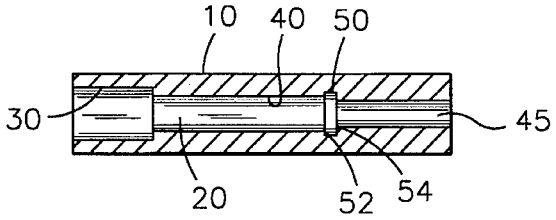
FIG. 2 is a cross-sectional view of a ceramic housing of the invention.
Figure 3A:
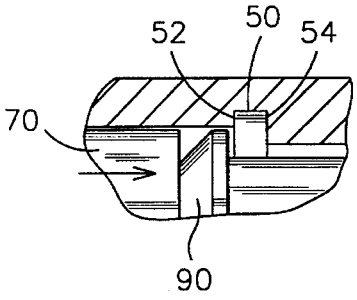
FIG. 3A is a partial cross-sectional view of the invention, illustrating an umbrella portion of the electrode and an annular groove portion of the housing.
Figure 3B:
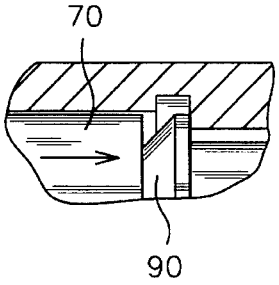
FIG. 3B is a partial cross-sectional view of the invention, illustrating the umbrella portion making contact with a second side wall portion of the annular groove portion of the housing.
Figure 3C:
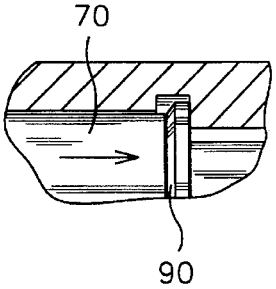
FIG. 3C is a partial cross-sectional view of the invention, illustrating the umbrella portion as expanded into the annular groove portion after being flattened against the second side wall.

FIGS. 3A–3C show an assembly for a spark electrode. A ceramic housing 10 (FIG. 2), preferably made from a high-density glazed alumina, has a cylindrical passage 20 therein. The passage 20 provides a relatively larger diameter clearance portion 30, a relatively smaller diameter slip fit portion 40, and an annular groove portion 50, and a connection portion 45. The annular groove portion 50 has a first annular side wall 52 and a second annular side wall 54. Since the connection portion has a smaller diameter then the slip fit portion the second annular side wall 54 extends further radially inwardly than does the first annular side wall 52 (FIG. 3A).

Figure 1:
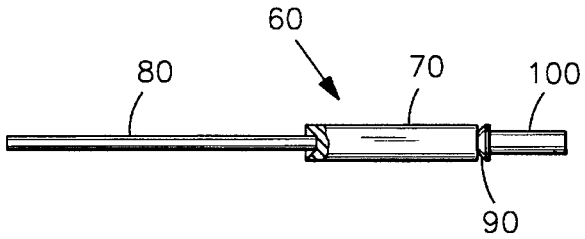
FIG. 1 is a side elevational view of the invention, illustrating a conductive metal electrode.

As seen in FIG. 1, a conductive metal electrode 60 of rod-like construction has a body portion 70 of a size for having sliding clearance within the slip fit portion 40 of the As seen in FIG. 1, a conductive metal electrode 60 of rod-like construction has a body portion 70 of a size for having sliding clearance within the slip fit portion 40 of the cylindrical passage 20. The electrode 60 is preferably made from an alloy comprising 22.5% chromium, 4.6% aluminum, 0.5% silicon, 0.1% carbon, and 72.3% iron, although clearly other metallic alloys could be found suitable by those skilled in the art. An emitter portion 80 of smaller diameter than the body portion 70 is positioned on one side of the body portion 70 and extends concentrically within the clearance portion 30 of the passage 20. On the other side of the body portion 70 is positioned an umbrella shaped portion 90 and a wire connection portion 100, which includes a wire attachment means 110 such as a solder weld, crimping of the wire connection portion 100 around a wire, or the like. The umbrella portion 90 has a cone shaped exterior surface forming an angle of approximately 30 degrees with the longitudinal axis of the electrode 60. The cone shaped exterior surface is the cover of a solid cone. Experimentation convincingly shows that the angle of 30 degrees, plus or minus a few degrees, is superior to all other angles in controlling deformation of the umbrella portion 90 under impact, so that the umbrella portion deforms into the annular groove portion of the housing enough to capture the electrode in the housing but not so much as to place the housing in danger of cracking from thermal expansion of the electrode when brought to a high temperature.

During assembly, with the electrode 60 inserted into the housing 10, the umbrella portion contacts the second annular side wall 54. This is shown as follows, in the sequence of FIGS. 3A illustrating the insertion of the electrode into the cylindrical passage 20, where it is noted that both the body 70 and the umbrella 90 portions are slid through the slip fit portion 40 of the housing, 3B illustrating that the umbrella portion 90 abuts the second annular side wall 54, and 3C illustrating the deformation of the umbrella portion 90. When a force is delivered to the one end of the body portion 70 of the electrode 60, such as by a suitable driving tool 65 shown in FIGS. 4A and 4B, the umbrella portion 90 is flattened against the second side wall 54, forcing the umbrella portion 90 of the electrode 60 to expand into the annular groove portion 50 while also deforming the body portion 70 of the electrode 60 to cause it to wedge into the slip fit portion 40 of the cylindrical passage 20 (FIGS. 3 and 4). As such, the expanded umbrella portion 90 is captured in the annular groove portion 50 so that the electrode 60 is captured within the ceramic housing 10. The deformed body portion 70, in firm contact with the housing 10, prevents the electrode 60 from rotating or otherwise moving within the housing 10. Further, the emitter portion 80 is held at a distance from the side walls of the clearance portion 30 of the housing 10 so as to prevent shorting due to carbonaceous deposit build-up on the emitter portion 60. The majority of the body portion 70 is not deformed as seen in FIG. 4C, and it has ample room to expand within the passage 20 due to the selected relative diameters of the body portion 70 and the slip-fit portion 40 providing for thermal expansion therebetween.

Figures 4A, 4B, 4C:
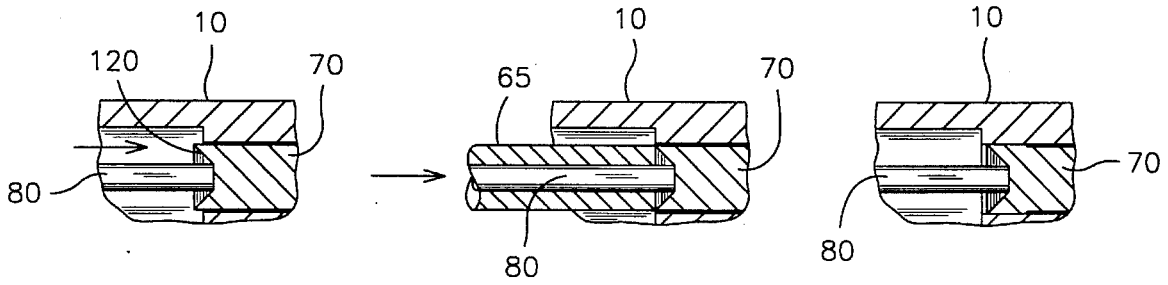
FIG. 4A is a partial cross-sectional view of the invention, illustration one end of a body portion of the electrode and a concave annular surface thereof.
FIG. 4B is a partial cross-sectional view of the invention, illustrating a driving tool driving the electrode into the housing.
FIG. 4C is a partial cross-sectional view of the invention, illustrating the body portion of the electrode wedged into a slip fit portion of the housing by the driving tool.
Figure 5:
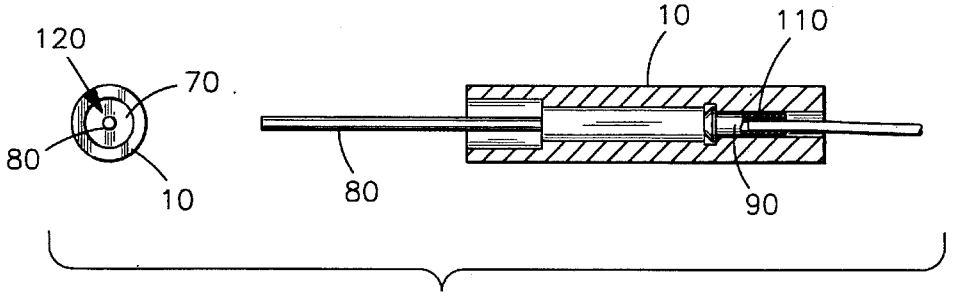
FIG. 5 is a combination front elevational view and cross sectional view of the invention, illustrating the electrode seated within the housing.

A concave annular surface 120 may be provided on the end of the body portion 70 that connects with the emitter portion, so that the body portion on that end is weakened and more easily deforms when subjected to an impact force for displacing the one side (FIGS. 4A, 4B, and 4C). Such a concave annular surface 120 preferably forms an angle of approximately 45 degrees with the longitudinal axis of the electrode. Experimentation convincingly shows that the angle of 45 degrees, plus or minus a few degrees, is superior to all other angles in controlling deformation of the body portion 70 under impact, so that the body portion 70 deforms against the slip-fit portion 40 of the housing enough to hold the electrode from moving or rotating within the housing but not so much as to place the housing in danger of cracking from thermal expansion of the electrode when brought to a high temperature.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A spark electrode device comprising:

a housing made of an electrically insulating material, providing a cylindrical passage therein, comprising, in sequence and mutually concentrically oriented along a longitudinal axis, a clearance portion, a slip fit portion, an annular groove portion, and a connection portion, the clearance portion, and the annular groove portion being of larger diameter than the slip fit portion, the connection portion being of lesser diameter than the slip fit portion, the annular groove portion defined by a first and a second annular side walls, the first of the walls abutting the slip fit portion, the second of the walls abutting the connection portion;

an integral, one-piece, electrically conducting, rod shaped electrode fitted into the cylindrical passage, and comprising, in sequence and mutually concentrically oriented along the longitudinal axis, an emitter portion, a body portion, an umbrella portion, and a wire connection portion, the emitter, body, umbrella and wire connection portions each primarily positioned in the clearance, slip fit, annular groove and connection portions respectively, of the housing, the body and umbrella portions of the electrode initially having a tightly-fitted sliding clearance relationship with the slip fit portion of the cylindrical passageway enabling insertion of the electrode into the housing, the emitter portion, and the wire connection portions, extending outwardly from opposite ends of the housing respectively, the body and umbrella portions, together, being of a length such that with the umbrella portion abutting the second of the annular side walls of the annular groove portion, the body portion extends slightly into the clearance portion of the housing in such a manner as to enable a force, delivered parallel to the longitudinal axis to be delivered thereto, the umbrella portion and the body portion being of such shape and size and space restriction relationship within the housing as to deform in a preferred manner from said force, to wit, the umbrella portion deforming expansively radially into the annular groove portion thereby capturing the electrode in the housing, and further the body portion deforming expansively radially, wedging the body portion in the slip-fit portion so that the electrode cannot rotate or move longitudinally in the housing.

2. The device of 1 wherein the emitter and body portions of the electrode mutually abut at a concave annular surface on the body portion said concave annular surface of such size and shape as to weaken the body portion thereat so as to easily deform radially under a longitudinal impact.

3. The device of claim 2 wherein the concave annular surface forms an angle of approximately 45 degrees with the longitudinal axis.

4. The device of claim 3 wherein the umbrella portion provides a conical external surface covering a solid cone, said surface forming an angle of approximately 30 degrees with the longitudinal axis.

* * * * *